US008111859B2

(12) United States Patent
Phillips

(10) Patent No.: US 8,111,859 B2
(45) Date of Patent: Feb. 7, 2012

(54) HEADGEAR AND INTEGRATED MUSIC PLAYER

(76) Inventor: Aaron M. Phillips, Granite Bay, CA (US)

( * ) Notice: Subject to any disclaimer, the term of this patent is extended or adjusted under 35 U.S.C. 154(b) by 1307 days.

(21) Appl. No.: 11/716,099

(22) Filed: Mar. 9, 2007

(65) Prior Publication Data

US 2008/0144872 A1 Jun. 19, 2008

Related U.S. Application Data

(60) Provisional application No. 60/780,996, filed on Mar. 9, 2006.

(51) Int. Cl.
*H04R 25/00* (2006.01)

(52) U.S. Cl. ..... 381/376; 381/374; 381/378

(58) Field of Classification Search ..... 381/380, 381/276–379, 384; 379/430; 455/575.2; 2/209, 267, 905, 906, 909, 918; 224/222, 224/676, 191

See application file for complete search history.

(56) References Cited

U.S. PATENT DOCUMENTS

| | | | | |
|---|---|---|---|---|
| 5,329,592 | A | 7/1994 | Altman | |
| 5,438,698 | A | 8/1995 | Burton | |
| 5,537,667 | A | 7/1996 | Kenning | |
| 5,625,903 | A * | 5/1997 | Schultz et al. | 2/209 |
| 5,680,465 | A | 10/1997 | Boyden | |
| 5,881,390 | A | 3/1999 | Young | |
| 5,953,434 | A | 9/1999 | Boyden | |
| 6,888,950 | B2 * | 5/2005 | Siskin et al. | 381/378 |
| 2002/0172390 | A1 | 11/2002 | Roberts | |
| 2002/0181727 | A1 | 12/2002 | Shen | |
| 2005/0123151 | A1 | 6/2005 | Whipple | |

FOREIGN PATENT DOCUMENTS

| | | |
|---|---|---|
| DE | 2005-016830 | 3/2006 |
| EP | 1094685 | 4/2001 |
| KR | 20-0385942 | 6/2005 |

OTHER PUBLICATIONS

Headprong; uSport Headband; www.headprong.com.

* cited by examiner

*Primary Examiner* — Tuan Nguyen
(74) *Attorney, Agent, or Firm* — Heisler & Associates

(57) ABSTRACT

A headgear assembly is provided with an integrated music or other sound player supportable therein. The headgear assembly includes a headband or cap with pouches therein for various portions of the music player. In particular, a left speaker pouch is provided for a left speaker, a right speaker pouch is provided for a right speaker and a player pouch is provided for a sound player. A wire harness is also provided to preferably removably attach the speakers to the sound player. The headband or cap with the pouches therein holds the player and speakers directly adjacent a head of the user, and with the speakers directly over ears of the user. Controls on the player are accessed through a window in an outer panel of the headband or cap to allow user access. The player, wire harness and speakers are all substantially concealed within the headgear assembly.

24 Claims, 3 Drawing Sheets

HEADGEAR AND INTEGRATED MUSIC PLAYER

CROSS-REFERENCE TO RELATED APPLICATIONS

This application claims benefit under Title 35, United States Code §119(e) of U.S. Provisional Application No. 60/780,996 filed on Mar. 9, 2006.

FIELD OF THE INVENTION

The following invention relates to headgear adapted to be worn upon a head of a user and which can also conveniently hold a sound player therein and sound speakers coupled to the sound player. More particularly, this invention relates to headgear and integrated sound/music players and speakers therefore which support the speakers adjacent ears of a user and the sound player all in a secure and substantially concealed configuration.

BACKGROUND OF THE INVENTION

Mobile sound generating devices come in a variety of different configurations. Most commonly, the mobile sound generating devices include a main unit (often called a "player") which stores the sound media and generates a sound signal in electronic form from the sound media, and transmits the sound signal to some form of speaker that may be attached to or remote from the player.

The sound media can be in the form of a removable media element, such as a cassette tape or compact disc. Alternatively, the media storage can be permanent, such as in the form of a small hard drive, flash memory, or other electronic or electromagnetic data storage device, such as are commonly utilized in computers or other electronics. The electronic sound signal generating device generally interacts with the storage device to retrieve a selected portion of a sound file and transmit the sound file in an appropriate format for driving a speaker so that the electronic signal is transmitted into audible sound waves. These players also typically include controls thereon which a user manipulates to select the sounds to be played, control volume and otherwise control the overall system.

While some mobile sound generating devices have loud speakers thereon, other mobile sound generating devices configure the speakers so that they rest directly adjacent ears of a user in the form of earphones, ear buds, or otherwise coupled to ears of a user, with the speakers coupled by a wire harness to the player of the overall device.

One drawback with this overall arrangement is that the wire harness often restricts the mobility of the user. For instance, if the user is actively engaged is some other activity which requires freedom of movement of the head, neck, arms, hands and body of the user, this wire harness can become entangled with the user and diminish the enjoyment or safety associated with the activity.

One known prior art method for dealing with this problem and also minimizing weight of the primary/main unit has been to shrink a size of the primary/main unit to a size where it can be conveniently worn upon the head of the user with the wire harness shortened to only extend from one part of a head of a user where the primary/main unit is located, to the ears of the user. In particular, European Patent Application No. 1,094,685 by Alastair Sibbald teaches a headphone system where a pair of speakers are configured for placement over ears of a user and are coupled to an inverted "U-shaped" headband and also coupled to an interchangeable unit which can be in the form of a radio receiver, disc player, MP3 player, tape player, mobile phone or T.V. tuner for generating an electronic sound signal and driving the speakers. The Sibbald headphone system of this European patent application is not entirely satisfactory in that it does not entirely gird a head of the user, and thus is inherently prone to becoming dislodged to some extent when the user is enjoying vigorous physical activity. Also, the interchangeable unit is fully exposed and visible, denying the wearer the opportunity to utilize the sound player in a subtle fashion.

German Patent Publication No. DE 2005016830 by Elimex GMBH teaches a headphone headband with speakers and a transmitter. This headphone and headband configuration actually includes both the headband portion and a separate transmitter which is used in conjunction with the headband in a wireless fashion. The Elimex published German patent application does not disclose providing pouches for the speakers within the headband or concealed pathways for a wire harness extending between the speakers and a sound player, and only discloses the speakers coupled to a receiver coupled to a separate transmitter, such that the unit is not entirely self-contained within the headband.

U.S. Pat. No. 5,438,698 to Burton et al. teaches a wearable audio reception device generally in the form of a radio receiver coupled to ear bud type earphones all supported by a headband. Burton fails to teach concealing the wire harness within the headband or concealing the radio device inside the headband. Pouches are not included for supporting the speakers or for the player.

Thus, while the prior art does include some headgear for sound player and speaker support, none of these prior art headgear products have fully satisfied the objective of completely integrating a sound player and speakers within a headband or related headgear in a fully concealed and fully supported fashion.

SUMMARY OF THE INVENTION

With this invention, headgear is provided along with an integrated music player and associated speakers which are all concealed within head girding headgear of either a headband or cap variety. The headgear assembly includes a headband or cap which includes a left speaker pouch for a left speaker, a right speaker pouch for a right speaker and a player pouch for supporting a sound player. Each of these pouches are oriented within the headband or cap for convenient operation of the headgear assembly. In particular, the speaker pouches are provided in locations which place them directly over ears of the user when the headband or cap is appropriately worn. The player pouch is preferably provided at a convenient location adjacent one of the temples of the user, with controls on the player accessed through a window in the pouch, such that only the controls of the player are exposed.

The pouches can be accessed through slits which allow the speakers and player to be removably located into appropriate pouches. A wire harness is provided which resides within a concealed pathway within the headgear assembly and couples the player to the speakers. This wire harness is preferably asymmetrical to accommodate the location of the player pouch closer to one of the speaker pouches than to the other of the speaker pouches.

Also, the wire harness is removably attachable both to the player and to the speakers in the preferred embodiment. In this way, decoupling of the wire harness from the speakers and the player is facilitated. The speakers and player can then be separately removed from the headband or cap so that the headgear can be washed or replaced with other headgear before reinsertion of the speakers and player for reuse according to this invention.

OBJECTS OF THE INVENTION

Accordingly, a primary object of the present invention is to provide a headgear assembly which can support a sound player and speakers therein.

Another object of the present invention is to provide a headgear assembly including both a head girding portion, a sound player and speakers, which can be worn by a user and play sound files for the user.

Another object of the present invention is to provide a headgear and integrated music player with the music player substantially concealed within the headgear.

Another object of the present invention is to provide headgear for supporting a sound player which supports the sound player and associated speakers securely on the head of a user so that the user can engage in a wide variety of physical activity without the sound player and speakers becoming dislodged.

Another object of the present invention is to provide a headgear and integrated music player assembly which can have a player and speakers thereof removed from fabric portions to facilitate cleaning of fabric portions.

Another object of the present invention is to provide headgear for supporting a sound player which has an attractive aesthetic appearance.

Another object of the present invention is to provide headgear for supporting a sound player which can support an MP3 player therein as well as speakers driven by the MP3 player and while facilitating access to controls on the MP3 player.

Other further objects of the present invention will become apparent from a careful reading of the included drawing figures, the claims and detailed description of the invention.

DESCRIPTION OF THE PREFERRED EMBODIMENT

Figure 9:
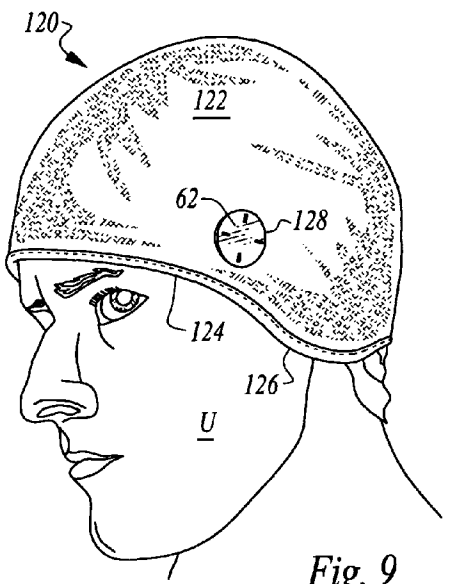
FIG. 9 is a perspective view of a cap embodiment of the headgear assembly of this invention, shown being worn by a user.

Referring to the drawings, wherein like reference numerals represent like parts throughout the various drawing figures, reference numeral 10 is directed to a headgear assembly (FIG. 1) including a headband 20 in a preferred embodiment capable of being worn by a user U and supporting a sound player 60 (FIGS. 2 and 3) driving speakers 80, 90 all supported within the headband 20. In an alternative embodiment, the headband 20 is replaced with a cap 120 (FIG. 9). With the headband 20 (or cap 120) entirely containing the sound player 60 and associated speakers 80, 90 (FIGS. 2 and 3). The entire headgear assembly 10 can be securely worn in a variety of physical activities while remaining in place and remaining substantially concealed within the headband 20 (or cap 120).

In essence, and with particular reference to FIGS. 1-3 and 6, basic details of the headgear assembly 10 are described, according to the preferred embodiment. The entire headgear assembly 10 is supported within a headband 20 which is adapted to gird a head of the user U. This headband 20 includes a left speaker pouch 30 adapted to be located adjacent a left ear E of the user U and a right speaker pouch 40 adapted to be placed adjacent to a right ear of the user U. A player pouch 50 is also oriented within the headband 20. A sound player 60 resides within the player pouch 50. A window 55 in the player pouch 50 passes through an outer panel 22 of the headband 20 and allows controls 62 of the sound player 60 to be accessed by the user U while the sound player 60 remains within the player pouch 50.

A wire harness 70 (FIG. 6) is preferably removably coupleable to the sound player 60. This wire harness 70 distributes an electronic sound signal to the left speaker 80 within the left pouch 30 and the right speaker 90 within the right speaker pouch 40. These speakers 80, 90 are placed directly adjacent ears of the user U with the headband 20 holding the speakers 80, 90 in position, for the user U to enjoy sound emanating from the speakers 80, 90 driven by the sound player 60. The speakers 80, 90 and sound player 60 are each preferably removably attachable to the wire harness 70 and from within the pouches 30, 40, 50 to facilitate easy removal of the sound player 60 and speakers 80, 90, such as for washing or substitution of the headband 20. Most typically, the wire harness 70 would remain within the headband 20 but could alternatively also be made to be removable from the headband 20.

Figure 1:
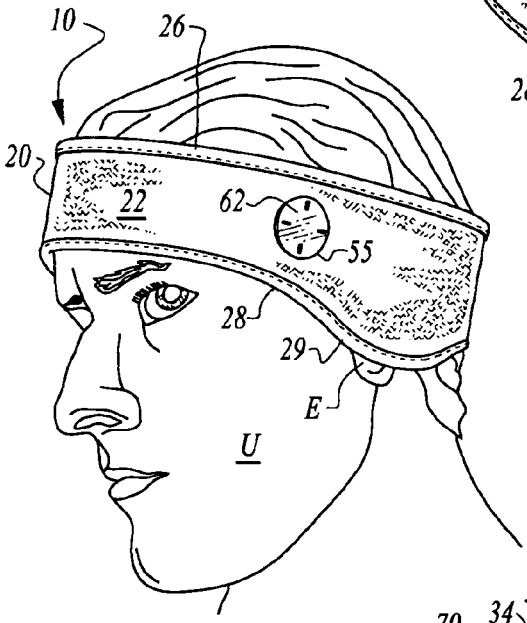
FIG. 1 is a perspective view of the headgear assembly of this invention according to a headband embodiment thereof and shown being worn and used by a user.
Figure 2:
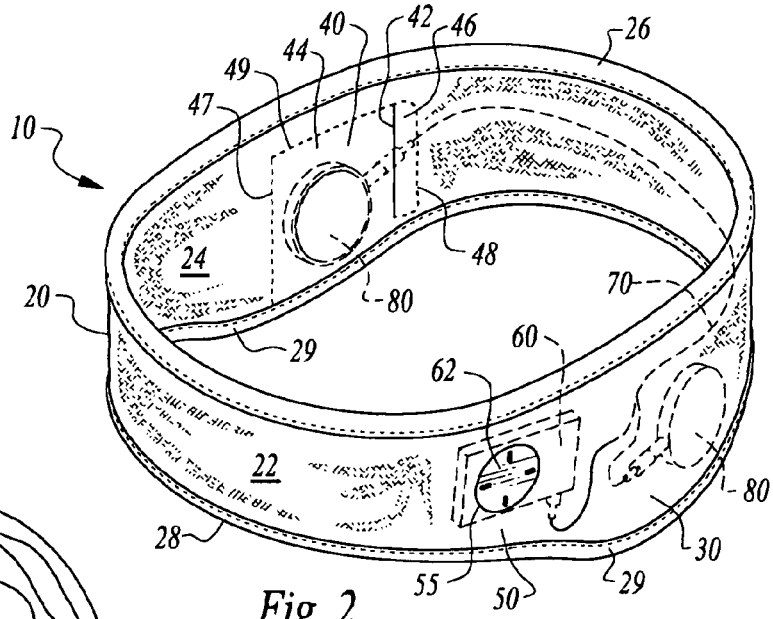
FIG. 2 is a perspective view of that which is shown in FIG. 1 but off of a user and with concealed portions of the assembly shown in broken lines.
Figure 3:
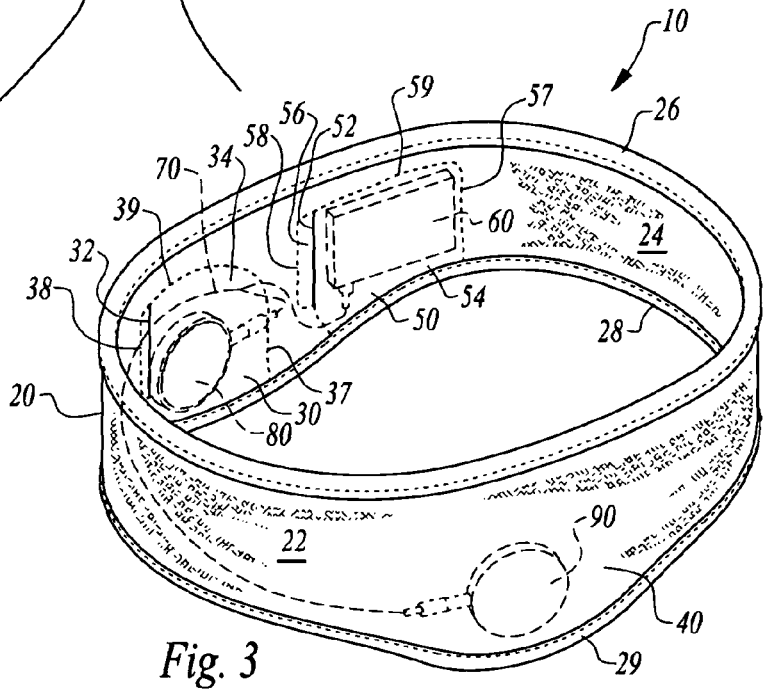
FIG. 3 is a perspective view similar to FIG. 2 but from a reverse angle.

More specifically, and with particular reference to FIGS. 1-3, details of the headband 20 are described according to the preferred embodiment. The headband 20 is a flexible band of material forming a circuit adapted to gird a head of the user U. In particular, the headband 20 is preferably sized and shaped so that it resides over a forehead of the user U and generally below a hairline above eyes of the user U. The headband 20 can then wrap around a backside of the head of the user U. Ear flares 29 preferably extend down on the headband 20 slightly so that the headband 20 covers at least upper portions of ears of the user U.

The ears E (FIG. 1) could optionally have at least lower portions thereof exposed below the ear flare 29. As an alternative, the entire headband 20 could be wider to accommodate ear coverage. Also, the ear flares 29 could be dispensed with and the speakers merely placed as close to the ears E as possible, with different head anatomy for different users U accommodating to different extents the close proximity of positioning of the speakers 80, 90 adjacent the ears E of the user U.

The headband 20 is formed of flexible material, such as common fabrics from which headbands and other clothing items are manufactured. This material is also preferably somewhat elastic so that it tends to grip the head of the user U slightly, but enough to remain firmly in place. In particular, the headband 20 preferably includes an outer panel 22 which circumscribes the entire circuit of the headband 20. An inner panel 24 preferably also entirely circumscribes the circuit of the headband 20, with the inner panel 24 optionally only provided adjacent the pouches 30, 40, 50 or otherwise extending less than entirely around the headband 20.

Each of the panels 22, 24 preferably extends from an upper edge 26 to a lower edge 28. The panels 22, 24 are preferably sewn together or otherwise attached adjacent the upper edge 26 and lower edge 28 with any of a variety of different types of seams to join the panels 22, 24 together. Most preferably, the lower edge 28 curves slightly adjacent each of the ear flares 29 to cause a height of the headband 20 between the upper edge 26 and lower edge 28 to be slightly increased adjacent each of the ears E of the user U. Otherwise, the upper edge 26 and lower edge 28 are preferably substantially parallel to each other and linear in form.

A left pouch 30 (best shown in FIGS. 3, 7 and 8) is preferably formed between a portion of the outer panel 22 and inner panel 24. In particular, stitching is preferably provided to form boundaries for the left pouch 30. Also, the inner panel 24 is preferably at least partially discontinuous adjacent the left speaker pouch 30 so that a slit 32 is formed in the inner panel 24. This slit 32 is preferably not configured merely by cutting the inner panel 24. Rather, the inner panel 24 preferably includes an under flap 34 and an over flap 36 with the slit 32 therebetween (see especially FIG. 8).

The under flap 34 preferably covers a larger portion of the left speaker pouch 30 than does the over flap 36, with a width of the under flap 34 and a width of the over flap 36 having a sum thereof which is greater than an overall width of the left speaker pouch 30. Thus, the over flap 36 overlaps somewhat the under flap 34. With this configuration, the flaps 34, 36 must be stretched somewhat so that the slit 32 can be accessed to allow the left speaker 80 to be placed within the left speaker pouch 30.

Conversely, the left speaker 80 cannot be easily removed or fall out of the left speaker pouch 30. Rather, the flaps 34, 36 must be stretched somewhat to access the slit 32 and allow the left speaker 80 to be removed from the left speaker pouch 30. Other slit or opening configurations could alternatively be provided to securely maintain the left speaker 80 within the left speaker pouch 30. For instance, some form of closure such as hook and loop fasteners, snaps, buttons, zippers, or other fasteners could be utilized to secure the left speaker 80 within the left speaker pouch 30.

The stitching coupling the inner panel 24 to the outer panel 22 and forming the left speaker pouch 30 preferably includes front stitching 37 extending substantially vertically and defining a front edge of the left speaker pouch 30. This stitching also preferably includes rear stitching 38 extending substantially vertically and defining a rear portion of the left speaker pouch 30. Also, preferably top stitching 39 is provided which extends substantially horizontally between the front stitching 37 and rear stitching 38 to define an upper portion of the left speaker pouch 30.

This stitching 37, 38, 39 is preferably sufficiently complete so that the left speaker 80, once within the left speaker pouch 30, cannot migrate into other regions between the inner panel 24 and outer panel 22, but rather remains within the left speaker pouch 30. However, this stitching 37, 38, 39 is preferably at least partially discontinuous on at least portions thereof to facilitate the routing of the wire harness 70 into and out of the left speaker pouch 30. Details of the wire harness 70 are described in detail below, with it merely being noted that for the left speaker pouch 30, preferably at least two discontinuities in the stitching 37, 38, 39 are provided. These discontinuities form gaps to facilitate one portion of the wire harness 70 extending to the sound player 60 and another portion of the wire harness 70 extending to the right speaker pouch 40.

The left speaker pouch 30 is preferably located down within the ear flare 29 of the headband 20 so that the left speaker 80 is positioned as close to the lower edge 28 of the headband 20 as possible and as low as possible to facilitate comfortable and desirable positioning of the left speaker 80 directly over a left ear of the user U.

Figure 7:
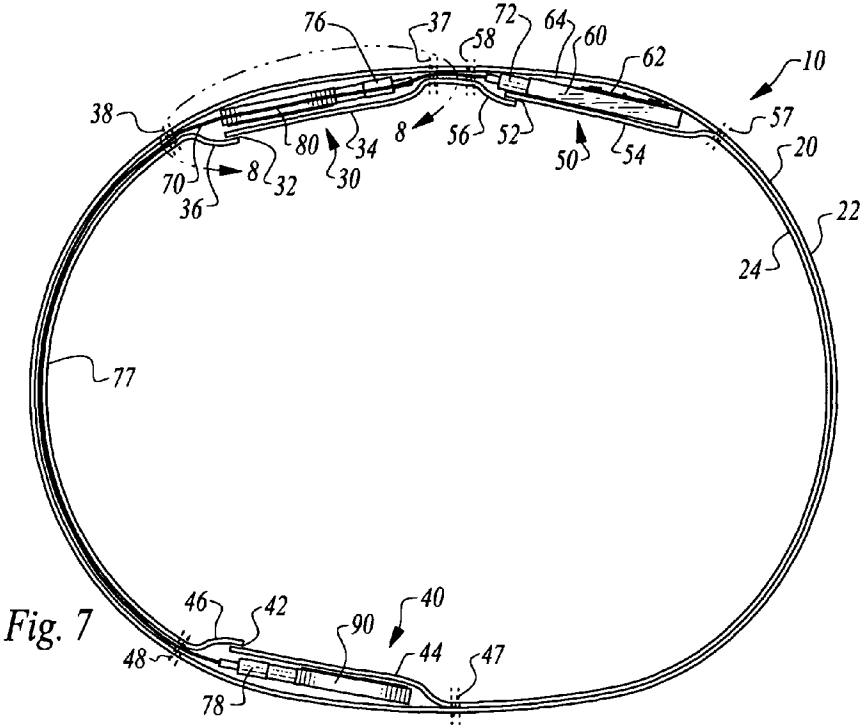
FIG. 7 is a top plan full sectional view of that which is shown in FIGS. 2 and 3.
Figure 8:
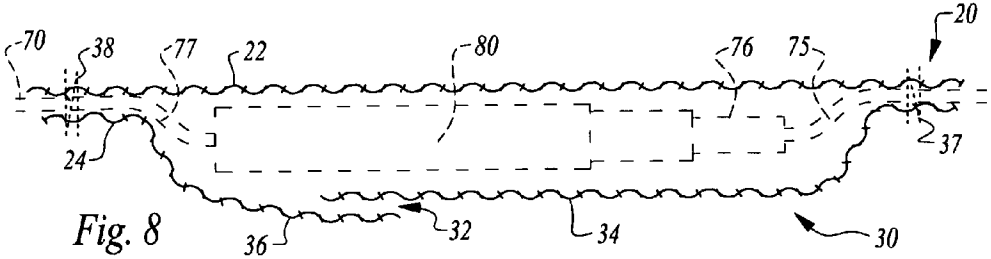
FIG. 8 is a top plan view of a portion of that which is shown in FIG. 7, shown in section taken along lines 8-8 of FIG. 7.

The right speaker pouch 40 is preferably configured similar to the left speaker pouch 30 (see especially FIGS. 2 and 7). In particular, the right speaker pouch 40 preferably is accessed through a slit 42 which is bounded by an under flap 44 and over flap 46, generally similar in configuration to the flaps 34, 36 of the left speaker pouch 30. The right speaker pouch 40 is preferably bounded by stitching including front stitching 47, rear stitching 48 and top stitching 49. This stitching 47, 48, 49 is preferably identical to the stitching 37, 38, 39 of the left speaker pouch 30, except that the right speaker pouch 40 is typically only accessed by a single portion of the wire harness 70, such that only one gap is required within the stitching. This gap is typically within the rear stitching 48 to facilitate coupling of the wire harness 70 to the right speaker 80 within the right speaker pouch 40.

The right speaker pouch 40 is preferably spaced from the left speaker pouch 30 by a distance which places these pouches 30, 40 substantially opposite each other on the headband 20 and configured where desired to overlie ears E of a user U. Typically, the headband 20 would be provided in different sizes to accommodate users with slightly different anatomy. Furthermore, as the anatomy of different users U might vary somewhat, either different speaker pouch 30, 40 positions can be provided in different sizes of headbands 20 or the pouches 30, 40 can be sized sufficiently large so that the speakers can be moved slightly within the pouches to accommodate the most desirable fit for individual users U and their particular unique anatomy around their ears E.

A player pouch 50 is also provided between the outer panel 22 and inner panel 24 of the headband 20. This player pouch 50 is most clearly shown in FIGS. 3 and 7. The player pouch 50 shares many similarities to the pouches 30, 40 for the speakers 80, 90. In particular, the player pouch 50 preferably includes a slit 52 bounded by an under flap 54 and over flap 56 formed in the inner panel 24 of the headband 20. Also, the player pouch 50 is preferably bounded by stitching including front stitching 57 substantially vertical and spaced from rear stitching 58. Top stitching 59 also preferably extends from the front stitching 57 to the rear stitching 58. This stitching 57, 58, 59 is preferably substantially continuous, with at least one gap preferably provided in the rear stitching 58 to facilitate a portion of the wire harness 70 extending out of the player pouch 50 and on toward the left and right speaker pouches 40, 30.

The stitching 57, 58, 59 is preferably spaced apart a precise distance and relative to stitching adjacent the lower edge 28 of the headband 20 to support a particular sound player 60 therein. For instance, one such player 60 is an MP3 player provided by Apple, Inc. of Cupertino, Calif. and provided under the trademark IPOD SHUFFLE. The player pouch 50 could be modified in size and shape to accommodate the particular geometry of different MP3 players if desired, such as an IPOD NANO by Apple, Inc., or the MP3 player or other players of other companies. Also, it is conceivable that the player pouch 50 could have a somewhat generic geometry, including size and shape to accommodate multiple different MP3 players. Other sound players 60 could also be accommodated by the player pouch 50 geometry, such as small radios, cell phones or other sound players 60 either known in the prior art or designed in the future.

The player pouch 50 preferably also includes a window 55 passing through the outer panel 22. This window is best seen in FIGS. 1 and 2. The window 55 provides an opening through the outer panel 22 allowing access to controls 62 on the sound player 60. Preferably, this window 55 is the only portion of the headband 20 which allows any portion of the sound player 60 or speakers 80, 90 or wire harness 70 to be visibly seen. Otherwise, sound generating and processing components of the assembly 10 are substantially concealed.

The window 55 is preferably circular in shape to accommodate circular controls 62 on the player 60. If the controls 62 are a different shape other than circular, this window 55 is preferably modified to accommodate a shape of the controls 62 on the sound player 60. The window 55 is preferably precisely located relative to the stitching 57, 58, 59 so that when the player 60 is located within the player pouch 50, the controls 62 of the player 60 are aligned precisely with the window 55. The window 55 is preferably sufficiently small so that no risk is presented that the player 60 could become dislodged out of the player pouch 50 through the window 55.

If required, portions of the player pouch 50 could be made less flexible than other portions of the headband 20 to maintain the player pouch 50 with a fairly static size and shape, and to prevent the window 55 from enlarging due to stretching of fabric forming the outer panel 22. For instance, a rigid or semi-rigid stiffening panel could be provided adjacent the player pouch 50 with a hole therein corresponding with a shape of the window 55 and sewn to the outer panel 22 along with the stitching 57, 58, 59. In this way, while the headband 20 could be somewhat adjustable in overall girth due to flexibility, and preferably also elasticity built into the fabric of the headband 20, the headband 20 could still maintain a substantially rigid and non-expanding form adjacent the player pouch 50. Such a stiffener could be very slightly curved to most comfortably adapt to the curving geometry of the head of a user U adjacent where the player pouch 50 is located.

Most preferably, this player pouch 50 is located forward of the left speaker pouch 30. Alternatively however, the player pouch 50 could be placed forward of the right speaker pouch 40 or could be located otherwise within the headband 20, such as at a midpoint between the speaker pouches 30, 40 and either adjacent a forehead of the user U or a back of the head of the user U when the headband 20 is worn by the user U. The pouches 30, 40, 50 provide preferred forms of supports for the player 60 and speakers 80, 90. Alternatively, other supports could be utilized including straps, bands, hook and loop fasteners, adhesives, brackets or other supports that are capable of attaching and holding the player 60 and speakers 80, 90 adjacent the headband 20.

Figure 6:
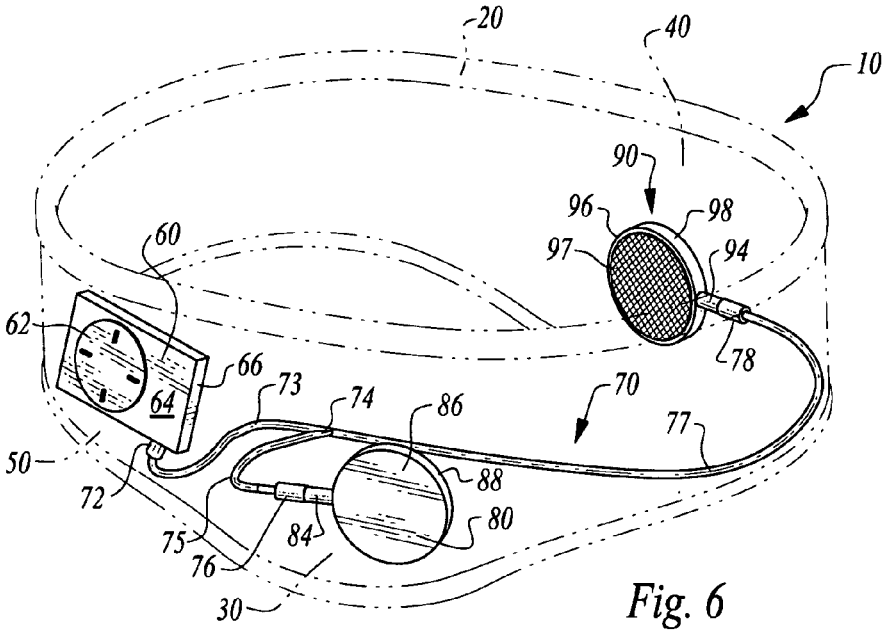
FIG. 6 is a perspective view of a sound player, wire harness and pair of speakers all assembled together according to this invention and with a headband portion of this invention shown in broken lines so that details of the player, wire harness and speakers can be most clearly seen.
Figure 4:
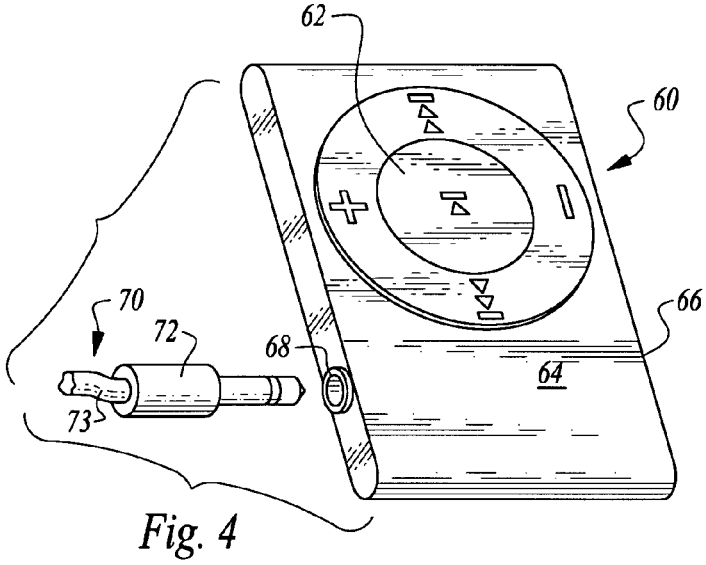
FIG. 4 is a perspective view of a sound player and an input jack of a wire harness illustrating how portions of the wire harness couple to the sound player.

With particular reference to FIGS. 4 and 6, particular details of the sound player 60 are described according to a preferred embodiment. As described above, the sound player 60 can be any form of MP3 player or sound player 60, either currently known in the prior art or in the future developed. The player 60 would typically have some means for storing a sound file and some means for generating an electronic signal capable of driving speakers in a way that causes an audible sound wave to be generated.

The sound player 60 would typically include some form of power supply (i.e. batteries) that powers a processor and associated circuitry therein to create the electronic sound signal and drive the speakers 80, 90. The player 60 includes a front 64 with controls 62 thereon. This front 64 is preferably inserted into the player pouch 50 adjacent the outer panel 22, such that the controls 62 can be adjacent the window 55 in the outer panel 22.

The sound player 60 includes a perimeter 66 which preferably has dimensions similar to that of the player pouch 50. Most preferably, this perimeter 66 is rectangular in form. A port 68 extends from a portion of this perimeter 66. This port 68 is configured so that it can receive an input jack 72 as a portion of the wire harness 70 therein, or some other form of electronic signal transmission line for routing the electronic sound signal to the speakers 80, 90.

With particular reference to FIGS. 6 and 7, details of the wire harness 70 are described. The wire harness 70 provides a preferred form of means for delivering the electronic sound signal from the sound player 60 to the speakers 80, 90. This wire harness 70 could have a variety of different configurations, such as built into the speakers 80, 90 and removably attachable to the sound player 60, as is most commonly provided with many such mobile sound playing devices. However, most preferably this wire harness 70 is both removably attachable to the sound player 60 and removably attachable to the speakers 80, 90. In this way, the speakers 80, 90 and player 60 can be most readily removed from the pouches 30, 40, 50, so that the headband 20 can be washed or replaced. While the harness 70 preferably remains within the headband 20, it could alternatively also be configured along with the headband 20 to facilitate wire harness 70 removal from the headband 20.

In the preferred embodiment, the wire harness 70 includes an input jack 72 adapted to be coupled to the port 68 and the sound player 60 so that the electronic sound file can pass through the port 68 and into the wire harness 70 through the input jack 72. The input jack 72 preferably is configured so that it can receive two separate signals, such as the left signal and right signal of a stereo sound signal. The input jack 72 is located at the end of an input leg 73. An end of the input leg 73 opposite the input jack 72 has a junction 74 thereon. The input leg 73 is preferably a flexible insulated length of wire that is electrically conductive for transmitting of the electronic sound signal through the wire harness 70.

A short leg 75 also extends from the junction 74 and terminates at a left output jack 76. A long leg 77 also extends from the junction 74 and terminates at a right output jack 78. Because the left speaker 80 is preferably adjacent to the sound player 60 when they are located in their respective pouches 30, 50, the left output jack 76 is located upon the short leg 75, rather than the long leg 77. The long leg 77 is sufficiently long so that it can extend past the left speaker pouch 30, around a rear portion of the headband 20, and terminate at the right speaker pouch 40, where the right output jack 78 is provided for removable attachment to the right speaker 90. The input leg 73 is preferably sufficiently long to extend from the player pouch 50 to the left speaker pouch 30. The short leg 75 is preferably just long enough to allow the left output jack 76 to be conveniently removably coupled to the left speaker 80. The junction 74 is preferably within the left speaker pouch 30, or very close to the left speaker pouch 30.

Each of the legs 73, 75, 77 is preferably similar in form in that they each include an insulated length of flexible wire. The short leg 75 and long leg 77 need only accommodate a single half of the two part sound signal, such as the left half of a stereo signal or the right half of a stereo signal. Most preferably, the input leg 73 and short leg 75 are of a similar short length with the long leg 77 significantly longer. This overall configuration of the wire harness 70 minimizes an amount of slack within the wire harness 70 and thus facilitates concealment of the wire harness 70 within the headband 20.

In particular, the wire harness 70 is generally routed between the outer panel 22 and inner panel 24 of the headband 20. Adjacent the pouches 30, 40, 50, the wire harness 70 has portions of the legs 73, 75, 77 routed past the stitching forming each of the pouches 30, 40, 50. Gaps in the stitching are provided just large enough so that the legs 73, 75, 77 and associated jacks 72, 76, 78 of the wire harness 70 can be routed into the pouches 30, 40, 50 and removed from the pouches 30, 40, 50 as desired. The entire wire harness 70 can optionally be configured to be removed from the headband 20, such as so that the headband 20 can be more thoroughly washed or the harness 70 or headband 20 replaced. As an alternative, at least a portion of stitching in the headband 20 can be replaced with hook and loop fasteners, (or buttons or snaps or a zipper) to facilitate access to the wire harness 70 and more simplified separation from the headband 20.

Figure 5:
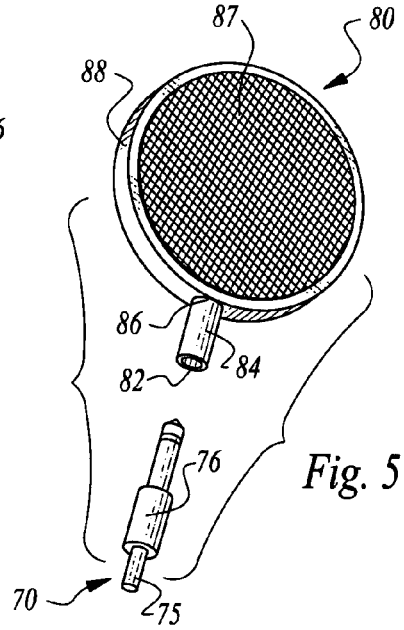
FIG. 5 is a perspective view of a speaker of the headgear assembly of this invention and an output jack of a wire harness of this invention illustrating how the speaker is removably coupleable to the wire harness in at least one embodiment of this invention.

With continuing reference to FIGS. 5-7, details of the speakers 80, 90 are described. The left speaker 80 is shown in particular in FIG. 5. This speaker 80 includes a receiver 82 adapted to receive the left output jack 76 therein and receive the electronic sound signal into the left speaker 80. A post 84 preferably extends from the left speaker 80 with the receiver 82 at an end of the post 84. Alternatively, the post 84 can be dispensed with and the receiver 82 could merely be provided in a portion of a ring 88 defining a perimeter of the left speaker 80.

A housing 86 defines an enclosure in which interior portions of the left speaker 80 are held in place and protected. One side of this housing 86 is designated as the face 87. This face 87 preferably has a foraminous surface to facilitate sound waves passing therethrough. The face 87 is oriented toward the inner panel 24 of the headband 20. This inner panel 24 is preferably sufficiently sound permeable so that sound waves from the left speaker 80 can pass through the face 87 in the housing 86, and then through the inner panel 24 before passing into the ear E of the user U.

The right speaker 90 is similar in form to the left speaker 80, including a post 94 preferably extending from a ring 98 surrounding a perimeter of a housing 96, and with a face 97 on one side of the housing 96. In fact, the right speaker 90 and left speaker 80 could most preferably be interchangeable with each other.

With particular reference to FIG. 9, details of an alternative to the headband 20 form of the headgear assembly 10 is described. In this embodiment, the headband 20 is replaced with a cap 120. The cap 120 is similar to the headband 20 except that the outer panel 20 is semi-spherical in form extending entirely over a head of the user. A lower edge 124 of the cap 120 is similar to the lower edge 28 of the headband 20. Thus, this lower edge 124 includes an ear flair 126 adjacent where the ears of the user U are located. The outer panel 122 preferably extends all the way from the lower edge 124 up over the head of the user U. The outer panel 122 preferably also includes a window 128 similar to the window 55 of the headband 20. This window 128 thus allows controls 62 on a sound player to be accessed through the outer panel 122 of the cap 120.

This disclosure is provided to reveal a preferred embodiment of the invention and a best mode for practicing the invention. Having thus described the invention in this way, it should be apparent that various different modifications can be made to the preferred embodiment without departing from the scope and spirit of this invention disclosure. When structures are identified as a means to perform a function, the identification is intended to include all structures which can perform the function specified. When structures of this invention are identified as being coupled together, such language should be interpreted broadly to include the structures being coupled directly together or coupled together through intervening structures. Such coupling could be permanent or temporary and either in a rigid fashion or in a fashion which allows pivoting, sliding or other relative motion while still providing some form of attachment, unless specifically restricted.

What is claimed is:

1. Headgear with integral sound player, comprising in combination:

at least one band of flexible material adapted to gird a head of a user;

at least one player pouch, said player pouch adapted to support an electronic sound signal generating source therein;

at least one player located within said player pouch, said player adapted to generate an electronic signal correlating with an audible sound;

at least one speaker pouch spaced from said player pouch;

at least one speaker located within said speaker pouch, said speaker adapted to generate audible sound waves;

a concealed pathway between said player pouch and said speaker pouch; and a wire harness located within said concealed pathway, said wire harness extending from said player to said speaker, said wire harness adapted to transmit the electronic sound signal from said player to said speaker.

2. The combination of claim 1 wherein said harness is removably attachable to at least one of said at least one player and said at least one speaker.

3. The combination of claim 2 wherein said wire harness is removably attachable to both said player and said speaker.

4. The combination of claim 3 wherein said wire harness includes at least one input jack and at least one output jack, said player including a port therein adapted to be removably coupled to said input jack, said speaker including a receiver therein, said receiver adapted to be removably coupled to said output jack.

5. The combination of claim 4 wherein said combination includes at least two speakers, each of said speakers including a similar receiver, said wire harness including at least three legs including an input leg removably coupled to said input jack, a left leg removably coupled to a left output jack and a right leg removably coupled to a right output jack, at least one of said legs longer than at least one of the other legs, with each of said legs joined together at a junction.

6. The combination of claim 5 wherein said input leg is shorter than at least one of said left leg and said right leg.

7. The combination of claim 1 wherein said player pouch includes a window therein, said window passing through said at least one band of flexible material, said window adapted to provide access through said at least one band of flexible material through which a user can access controls on said at least one player located within said player pouch.

8. The combination of claim 7 wherein at least two bands of flexible material are provided adjacent said player pouch, said at least two bands of flexible material oriented substantially parallel to each other with said player pouch therebetween, said at least two bands of flexible material coupled together sufficiently around a perimeter of said pouch, other than at a slit, to keep said player within said pouch except through said slit.

9. The combination of claim 8 wherein said slit is oriented between a pair of flaps including an under flap and an over flap, said over flap overlying said under flap, such that inadvertent displacement of said player out of said player pouch is discouraged.

10. The combination of claim 9 wherein each of said bands of flexible material is configured to completely gird a head of a user with a gap between said at least two bands providing at least a portion of said concealed pathway between said player pouch and said at least one speaker pouch, said at least two speaker pouches located spaced from each other upon said bands by a distance similar to a distance between ears of a user, such that each of said speaker pouches can be oriented generally overlying ears of the user, at least one of said bands including a flare on a lower edge thereof causing said band to be wider between an upper edge and a lower edge adjacent said speaker pouches than on portions of said band spaced from said speaker pouches.

11. The combination of claim 1 wherein said at least one band of flexible material has an upper edge.

12. The combination of claim 1 wherein said at least one band of flexible material is semi-spherical and adapted to both gird and cover the head of the user.

13. The combination of claim 1 wherein said electronic sound signal generating source includes a radio wave transmission receiver.

14. The combination of claim 1 wherein said electronic sound signal generating source includes a file storage for a sound file, the electronic sound signal generating source adapted to take the sound file from the storage and transmit the sound file as an electronic signal along wires to said audible air transmitted sound wave generator.

15. Headgear for supporting a sound player, comprising in combination:

at least one band of flexible material adapted to gird a head of a user;

an electronic sound signal generating source;

at least one player support, said player support adapted to hold said electronic sound signal generating source therein;

at least one speaker support spaced from said player support;

an audible air transmitted sound wave generator; and said speaker support having said audible air transmitted sound wave generator therein.

16. The headgear of claim 15 wherein said at least one band of flexible material includes a lower edge, said lower edge having at least one flare adjacent said speaker support.

17. The headgear of claim 15 wherein said headgear includes at least two speaker supports spaced from each other by a distance similar to a distance between ears on the head of the user.

18. The headgear of claim 17 wherein each of said speaker supports includes a speaker pouch defined at least partially by stitching between said at least one band of flexible material and a second band of flexible material parallel with at least portions of said at least one band of flexible material, said stitching joining said at least one band of flexible material with said second band of flexible material.

19. The headgear of claim 18 wherein said stitching includes gaps therein, said gaps adapted to allow routing of a wire harness therethrough for removably coupling a player within said player support from a speaker within at least one of said speaker pouches, said gaps in said stitching smaller than equipment to be contained therein, such that said gaps do not allow speaker movement therethrough.

20. The headgear of claim 19 wherein each of said speaker pouches includes a speaker therein, said speaker adapted to generate audible sound waves, each of said speakers coupled to a common wire harness, wherein said harness is adapted to be removably attached to both said player and said speaker; wherein said wire harness includes at least one input jack and at least one output jack, said input jack adapted to be removably coupled to the source, said speaker including a receiver therein, said receiver adapted to be removably coupled to said output jack; wherein said combination includes at least two speakers, each of said speakers including a similar receiver, said wire harness including at least three legs including an input leg coupled to said input jack, a left leg coupled to a left output jack and a right leg coupled to a right output jack, at least one of said legs longer than at least one of the other legs, with each of said legs joined together at a junction; and wherein said input leg is shorter than at least one of said left leg and said right leg.

21. The headgear of claim 15 wherein said at least one band of flexible material includes a window passing therethrough adjacent said at least one player support, said window adapted to allow a user to access controls of a player located on an inner side of said band and held by said player support.

22. The headgear of claim 21 wherein said window is substantially circular in form.

23. The headgear of claim 15 wherein said electronic sound signal generating source includes a radio wave transmission receiver.

24. The headgear of claim 15 wherein said electronic sound signal generating source includes a file storage for a sound file, the electronic sound signal generating source adapted to take the sound file from the storage and transmit the sound file as an electronic signal along wires to said audible air transmitted sound wave generator.

* * * * *